US011674296B2

(12) United States Patent
Halloran et al.

(10) Patent No.: US 11,674,296 B2
(45) Date of Patent: Jun. 13, 2023

(54) QUICK-COUPLING MECHANISM FOR TOILET AND METHOD OF USING SAME

(71) Applicant: Kohler Co., Kohler, WI (US)

(72) Inventors: Daniel Halloran, Fredonia, WI (US); Kristy Pelon, Sheboyan Falls, WI (US)

(73) Assignee: Kohler Co., Kohler, WI (US)

( * ) Notice: Subject to any disclaimer, the term of this patent is extended or adjusted under 35 U.S.C. 154(b) by 102 days.

(21) Appl. No.: 17/201,285

(22) Filed: Mar. 15, 2021

(65) Prior Publication Data

US 2021/0285198 A1 Sep. 16, 2021

Related U.S. Application Data

(63) Continuation of application No. 62/990,030, filed on Mar. 16, 2020.

(51) Int. Cl.
*E03D 1/38* (2006.01)
*E03D 1/26* (2006.01)

(52) U.S. Cl.
CPC ..... *E03D 1/38* (2013.01); *E03D 1/266* (2013.01)

(58) Field of Classification Search
CPC ..... E03D 1/26; E03D 1/266; E03D 1/38
See application file for complete search history.

(56) References Cited

U.S. PATENT DOCUMENTS 1,629,693 A * 5/1927 Foltz ..... E03D 1/38 4/418
1,771,007 A * 7/1930 Weaver ..... E03D 1/38 4/418
1,773,722 A * 8/1930 Bonner, Jr. ..... E03D 1/38 4/418
2,590,471 A * 3/1952 Smith ..... E03D 1/26 285/137.11
3,140,072 A 7/1964 Scinto, Jr.
3,743,333 A 7/1973 Kosinski
4,025,738 A 5/1977 Erwin et al.
4,041,729 A 8/1977 Bilz
4,211,253 A 7/1980 Ekman
4,340,082 A 7/1982 Straus
(Continued)

OTHER PUBLICATIONS

PCT International Search Report and Written Opinion of International Searching Authority, corresponding to PCT International Application No. PCT/US21/22338 dated Jun. 2, 2021.

*Primary Examiner* — J C Jacyna
(74) *Attorney, Agent, or Firm* — Lempia Summerfield Katz LLC

(57) ABSTRACT

At least one embodiment relates to a quick-coupling mechanism including a clamp spring configured to receive a valve body. The clamp spring is coupled to a release button configured to manipulate one or more arms of the clamp spring. The quick-coupling mechanism includes a base structure coupled to the toilet pedestal/bowl. The base structure is configured to hold the clamp spring in place. In a locking-state, the clamp spring seats in a groove in the valve body thus securing the valve body in place and preventing an axial movement of the valve body relative to the clamp spring. In a non-locking state, the release button bends the arms of the clamp spring outwardly to increase the diameter of the clamping portion, thus releasing valve body such that the valve body can move axially relative to the clamp spring.

18 Claims, 11 Drawing Sheets

(56) References Cited

U.S. PATENT DOCUMENTS

| | | | | |
|---|---|---|---|---|
| 4,531,872 | A | 7/1985 | Warkotsh | |
| 4,599,019 | A | 7/1986 | Ueberall | |
| 4,871,629 | A | 10/1989 | Bunyea | |
| 5,103,507 | A | 4/1992 | Sprajc et al. | |
| 5,401,000 | A | 3/1995 | Tsay | |
| 5,598,865 | A | 2/1997 | Musso | |
| 6,176,322 | B1 | 1/2001 | Wadge | |
| 6,192,526 | B1 * | 2/2001 | Nichols-Roy | E03D 1/306 285/139.2 |
| 6,199,920 | B1 | 3/2001 | Neustadtl | |
| 6,206,432 | B1 | 3/2001 | Kamiyama | |
| 6,551,041 | B2 | 4/2003 | Choate | |
| 6,553,642 | B2 | 4/2003 | Driessen | |
| 6,561,523 | B1 | 5/2003 | Wienhold | |
| 6,634,439 | B2 | 10/2003 | Driessen | |
| 6,675,911 | B2 | 1/2004 | Driessen | |
| 6,908,118 | B2 | 6/2005 | Fumioka | |
| 7,021,399 | B2 | 4/2006 | Driessen | |
| 7,793,572 | B2 | 9/2010 | Hirt et al. | |
| 7,950,699 | B2 | 5/2011 | Bauer et al. | |
| 8,303,000 | B2 | 11/2012 | Liu | |
| 8,356,794 | B1 | 1/2013 | Liu | |
| 8,360,439 | B2 | 1/2013 | Hirt et al. | |
| 8,632,052 | B2 | 1/2014 | Liu | |
| 8,641,013 | B2 | 2/2014 | Liu | |
| 9,751,176 | B2 | 9/2017 | Mcroberts et al. | |
| 9,845,593 | B2 | 12/2017 | Hall et al. | |
| 2006/0207661 | A1 | 9/2006 | Morrison | |
| 2008/0066223 | A1 | 3/2008 | Halloran | |
| 2009/0255043 | A1 | 10/2009 | Halloran et al. | |
| 2013/0312172 | A1 * | 11/2013 | Swart | E03D 1/26 137/15.18 |
| 2017/0321403 | A1 | 11/2017 | Guthrie | |
| 2017/0326699 | A1 | 11/2017 | Mcroberts et al. | |

* cited by examiner

QUICK-COUPLING MECHANISM FOR TOILET AND METHOD OF USING SAME

This application claims priority benefit of Provisional Application No. 62/990,030 filed Mar. 16, 2020, which is hereby incorporated by reference in its entirety.

BACKGROUND

The present application relates generally to toilet bowl and tank attachments. More specifically, the present application relates to quick-coupling toilet bowl and tank attachments and the methods of attaching toilet tanks to toilet bowls using such quick-coupling attachments/assemblies.

Current systems like this require moderate level of mechanical aptitude, which may be beyond the ability of some potential customers who would like to install the system without the assistance of a professional. Further, the attachment and/or leveling systems can be somewhat time consuming. Thus, it would be advantageous to provide a secure, leak free toilet tank-to-bowl coupling system, with significantly faster and easier installation that overcomes the foregoing challenges. These and other advantageous features will become apparent to those reviewing the present disclosure.

SUMMARY

At least one embodiment relates to a quick-coupling mechanism. The quick-coupling mechanism includes a clamp spring configured to receive a valve body. The clamp spring is coupled to a release button configured to manipulate one or more arms of the clamp spring, such as to change a diameter of a clamping portion of the clamp spring. The quick-coupling mechanism includes a base structure coupled to the toilet pedestal/bowl. The base structure is configured to hold the clamp spring in place. In a locking-state, the clamp spring seats in a groove in the valve body thus securing the valve body in place and preventing an axial movement of the valve body relative to the clamp spring. In a non-locking state, the release button bends the arms of the clamp spring outwardly to increase the diameter of the clamping portion, thus releasing valve body such that the valve body can move axially relative to the clamp spring.

This summary is illustrative only and is not intended to be in any way limiting.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

The following description focuses primarily on quick-coupling mechanisms for connecting a toilet tank and a toilet bowl, but it should be appreciated that the disclosed quick-coupling mechanism can be applied to other coupled components in the sanitation environment (e.g., bidets, urinals, etc.) to provide a quick mode of attachment. Current coupling, or gasket, systems for two piece toilets (i.e., where the tank and bowl are formed separately then coupled together) require two or three studs extend through the mounting bracket to engage holes in the top of the bowl/pedestal. Nuts are coupled to the studs to secure the system to the bowl.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, disclosed herein are quick-coupling mechanisms for connecting a toilet tank to a toilet bowl, or pedestal, for instance. According to an exemplary embodiment, the quick-coupling mechanism has a clamp spring coupled to a release tab/button, wherein the clamp spring receives a valve body and seats in a groove in the valve body. Further, a base structure, coupled to the toilet pedestal/bowl, holds the clamp spring in place. In some embodiments, the base structure may be coupled to the bottom of the toilet tank, such that a tube extends up from the bowl to engage the clamp spring and the flush valve body in the toilet tank. The release button manipulates (e.g., bends, splays, etc.) the clamp spring, thus releasing valve body. Some benefits of such a configuration include, for example, (1) reduced installation time, (2) reduces installation difficulty, and (3) a secure connection between the toilet bowl and tank that prevents leaks.

Figure 1A:
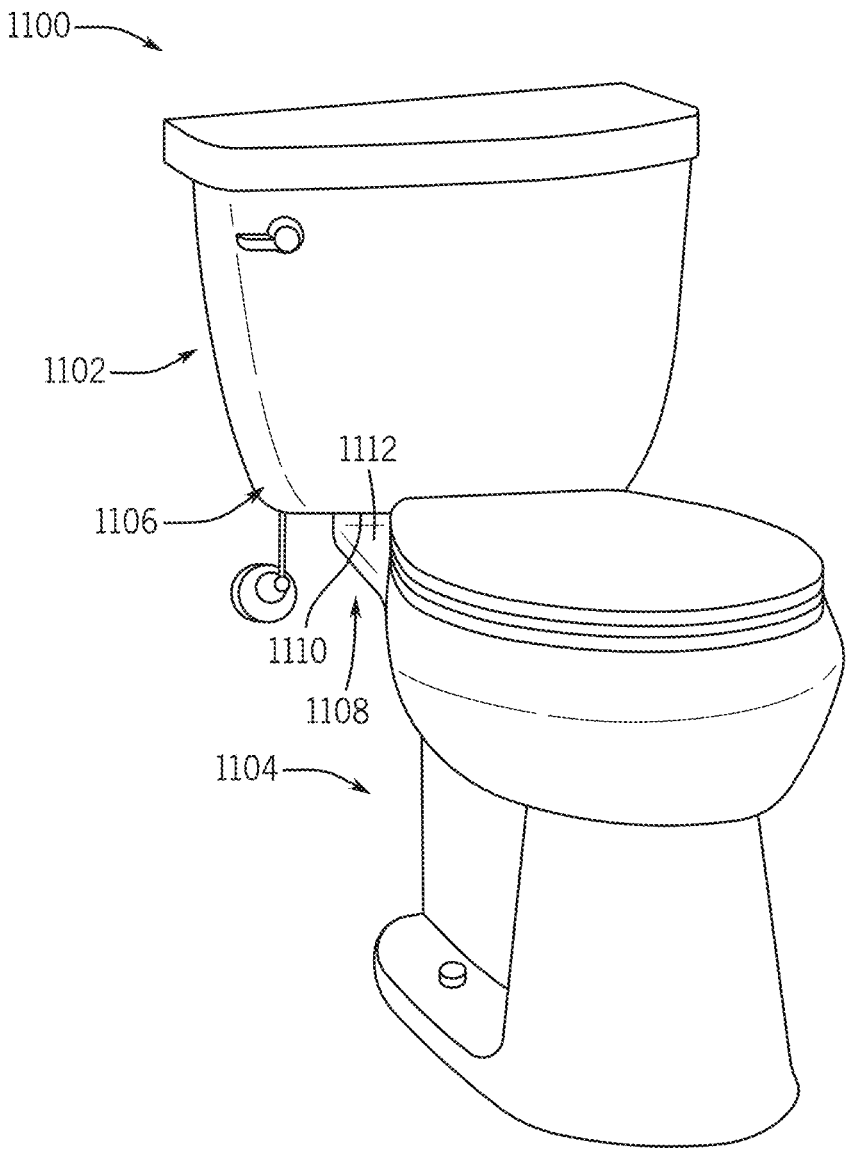
FIG. 1A includes a toilet configured with a quick-coupling mechanism.
Figure 1B:
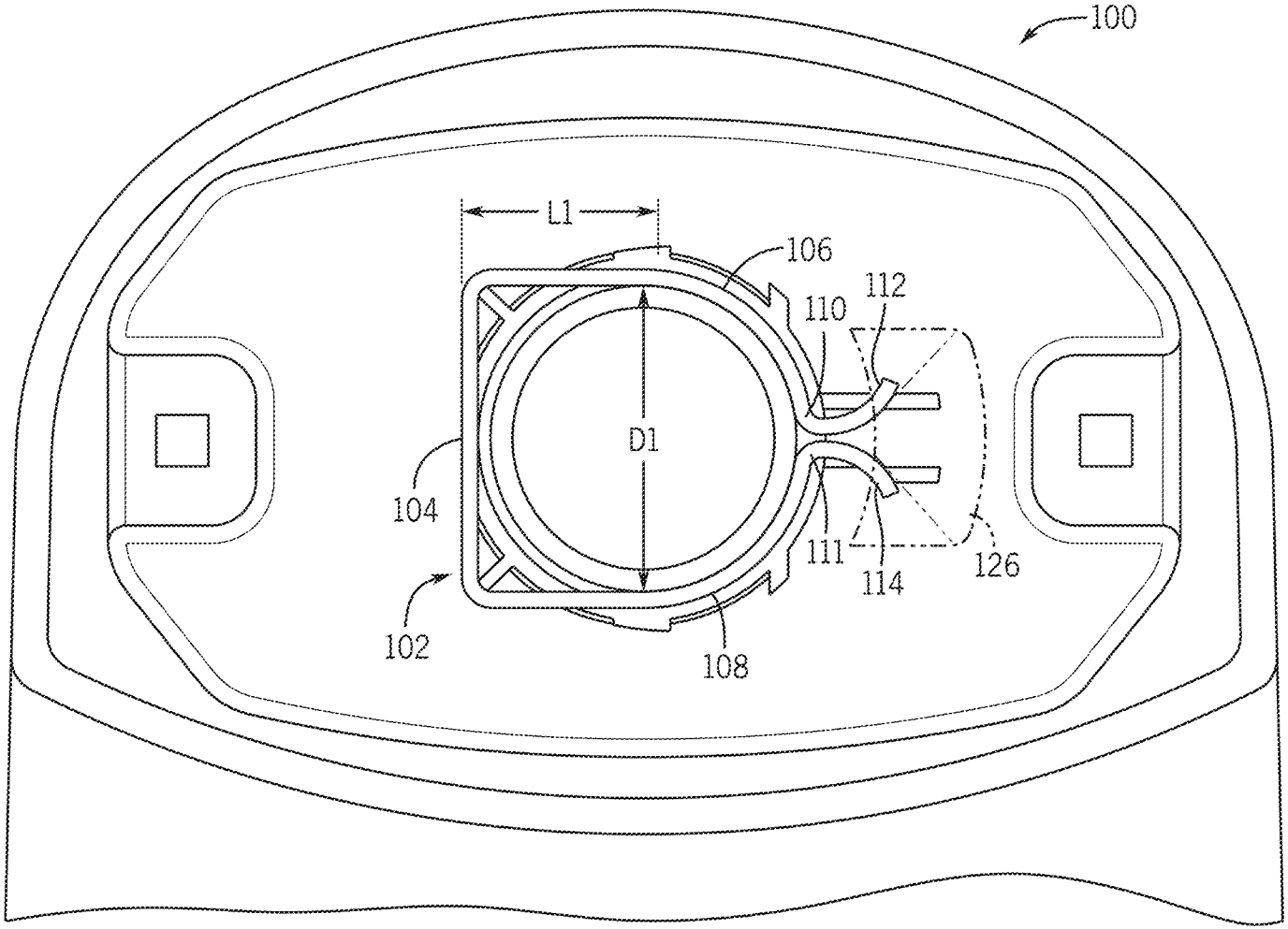
FIG. 1B is a top view of the quick-coupling mechanism, in accordance with an exemplary embodiment of the present application.

Referring now to FIG. 1A, a toilet 1100 is illustrated according to an exemplary embodiment including a quick-coupling mechanism. The toilet 1100 includes a tank (e.g., container, reservoir, etc.), shown as a tank 1102, and a pedestal (e.g., base, stand, support, etc.), shown as a pedestal 1104. The tank 1102 is coupled to, and supported by, the pedestal 1104, which is configured to be positioned on a floor. The tank 1102 is configured to receive water (e.g., via a fill valve of the toilet 1100, etc.) and store the water in between flushes. The pedestal 1104 includes a bowl and is configured to receive the water from the tank 1102 to flush contents of bowl into a sewage line. The tank 1102 is configured to be secured to the pedestal 1104 via a quick-coupling mechanism.

The tank 1102 includes a wall (e.g., boundary, body, structure, etc.), shown as a bottom wall 1106, and the pedestal 1104 includes a protrusion (e.g., projection, extension, etc.), shown as a lip 1108. The bottom wall 1106 defines a surface (e.g., side, face, etc.), shown as a bottom surface 110. The lip 1108 extends (e.g., protrudes, projects, etc.) underneath the bottom wall 1106 and includes a surface, shown as a top surface 1112. The tank 1102 is coupled to the pedestal 1104 such that the bottom surface 1110 of the bottom wall 1106 is adjacent to (e.g., opposite of, in confronting relation with, etc.) the top surface 1112 of the pedestal 1104.

Referring to FIGS. 1B, 2, 3, 4, and 5, a quick-coupling mechanism 100 is shown according to an exemplary embodiment. The quick-coupling mechanism 100 may be applied to the toilet 1100. The quick-coupling mechanism 100 includes a clamp spring 102, which is shown as a resilient member. As shown in FIG. 1, the clamp spring 102 includes a base portion 104 with a first arm 106 and a second arm 108 extending therefrom. The base portion 104 can include a straight and/or flat portion of the clamp spring 102. The first and second arms 106, 108 extend from the base portion 104 parallel to each other and away from the base portion 104, such that the first and second arms 106, 108 each form right angles with the base portion 104. The first and second arms 106, 108 may form rounded angles with the base portion 104. In some embodiments, the first and second arms 106, 108 are obliquely angled relative to the base portion 104 (e.g., 75 degrees, 80 degrees, 100 degrees, etc.). The first and second arms 106, 108 symmetrically extend for a length L1 and curve toward one another, with a first end 110 of the first arm 106 and a second end 111 of the second arm 108 meeting at a point opposite from the base portion 104 such that the first and second ends 110, 111 are separated from the base portion 104 by a valve body 101. In other words, the base portion 104 and the length L1 of the first and second arms 106, 108 form three sides of a rectangular shape, or a "C" or "U" shape, for instance, and the curved portion of the first and second arms 106, 108 form a semicircular shape with a diameter D1. As such, the clamp spring 102 is sized and shaped to receive the valve body 101. The clamp spring 102 further includes a first tab 112 and a second tab 114 extending out from the first and second ends 110, 111, respectively. As illustrated, the first and second tabs 112, 114 have confronting curved surfaces. In some embodiments, the first and second tabs 112, 114 may have outwardly curved surfaces or straight surfaces (e.g., the first and second tabs 112, 114 extend parallel to each other or away from each other at 45 degree angles).

Figure 2:
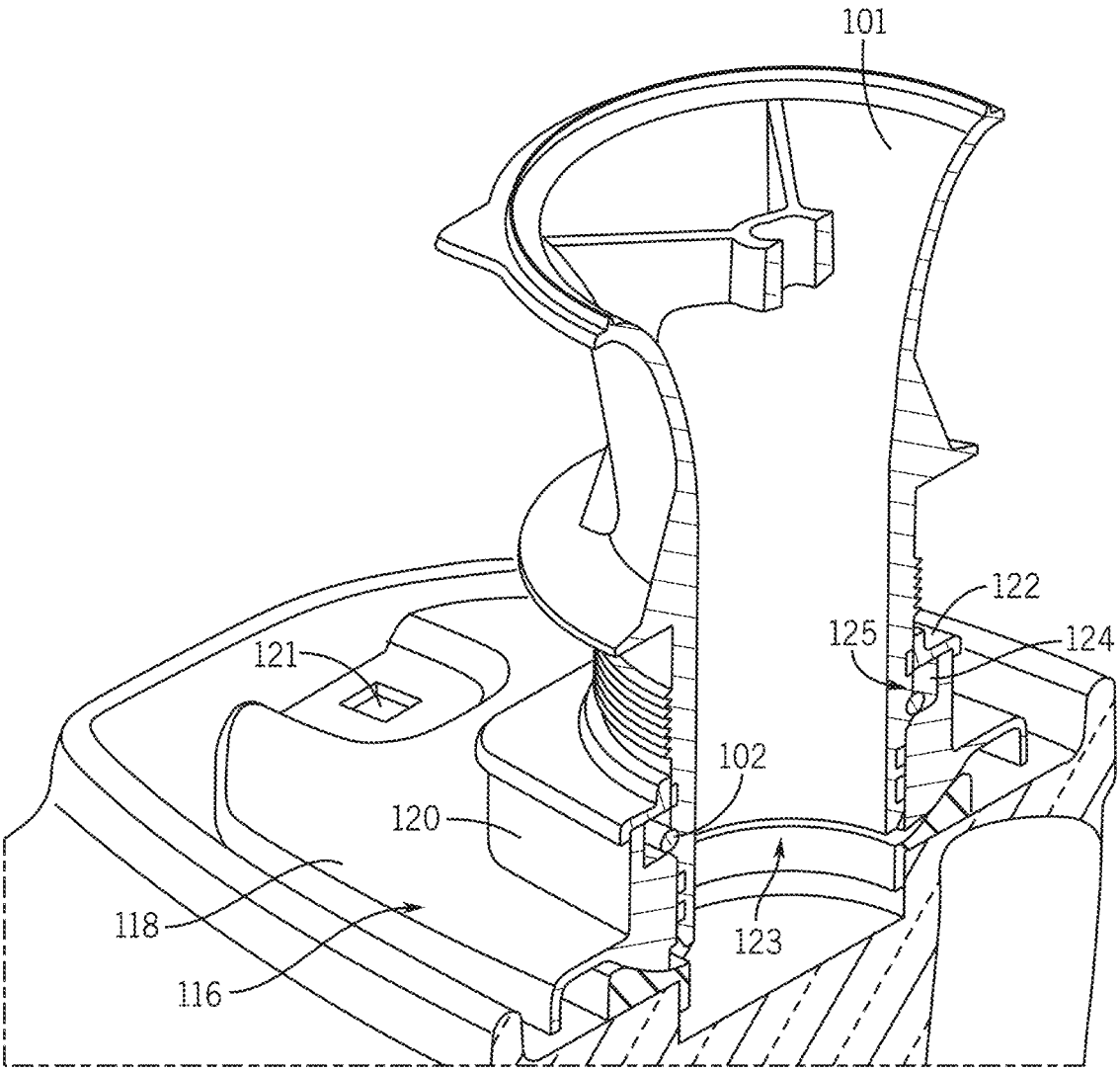
FIGS. 2 and 3 are perspective views of the quick-coupling mechanism of FIG. 1.
Figure 3:
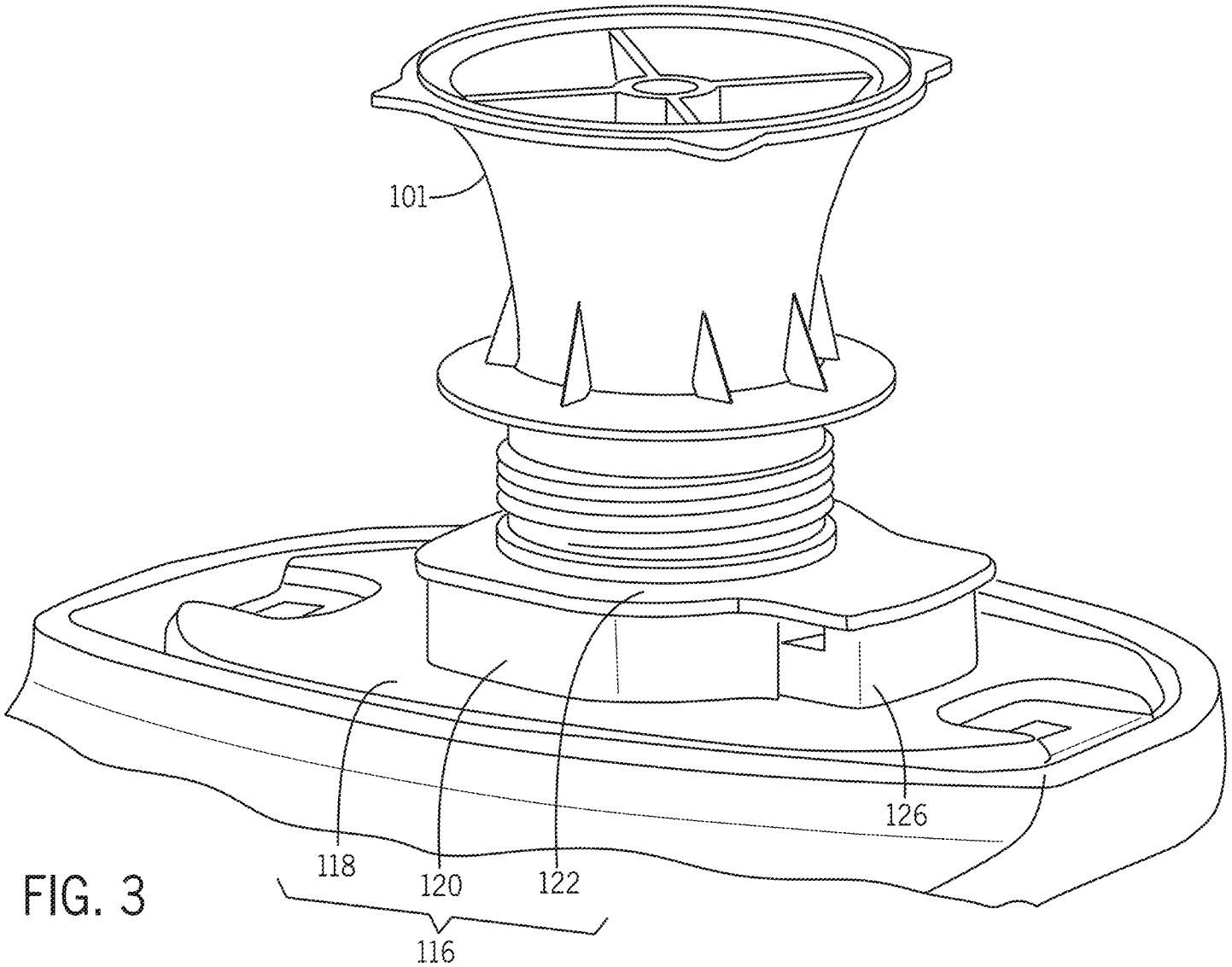

The quick-coupling mechanism 100 includes a base structure 116, which is configured to hold the clamp spring 102 in place. As shown in FIG. 2, the base structure 116 includes a bottom member 118, a top member 122, and a wall 120 extending between the bottom member 118 and the top member 122. The wall 120 generally corresponds to the shape of the clamp spring 102 as described herein. The bottom member 118 is configured to couple to the toilet pedestal/bowl, such as using fasteners that engage the pedestal 1104 through one or more holes 121. The fasteners may be bolts, screws, or another device. The fasteners may be formed of metal, plastic or a polymer. The fasteners may include one or more nuts, washers or seals (e.g., o-ring).

The base structure 116 includes a bore 123 that extends in a longitudinal direction relative to the valve body 101. As show in FIG. 2, the longitudinal direction is transverse (e.g., orthogonal) to a base of the bottom member 118. The illustrated bore 123 has a circular cross-sectional shape to receive the valve body 101. The base structure 116 further includes an annular channel 124. The bottom member 118, the wall 120, and the top member 122 cooperate to define the annular chamber 124. As shown in FIG. 2, the annular channel 124 receives the spring clamp 102 or at least a portion thereof (e.g., the base portion 104, the first or second arms 106, 108, etc.). As shown in FIG. 2, the valve body 101 is inserted into the bore 123 and inside the clamp spring 102, such that the first and second arms 106, 108 of the clamp spring 102 are positioned between a portion of the valve body 101 and a portion of the wall 120 defining the annular channel 124. The base structure 116 may further include securing features (e.g., tabs, nooks, walls, etc.) that hold parts of the clamp spring 102 in place, such as base portion 104 and/or the first and second arms 106, 108. Additionally, in a locking state (FIGS. 1 and 5), the clamp spring 102 seats in a groove 125 in the valve body 101 to hold the valve body 101 in place relative to the base structure 116. As such, the portions of the base portion 104 and the first and second arms 106, 108 that are seated in the groove 125 define what is referred to herein as the clamping portion. The base structure 116 prevents movement of the clamp spring 102 relative to the base structure 116 along a longitudinal axis of the valve body 101, as described in detail herein. In the locking state, the clamp spring 102 prevents movement of the valve body 101 relative to the clamp spring 102 along the longitudinal axis of the valve body 101.

Figure 4:
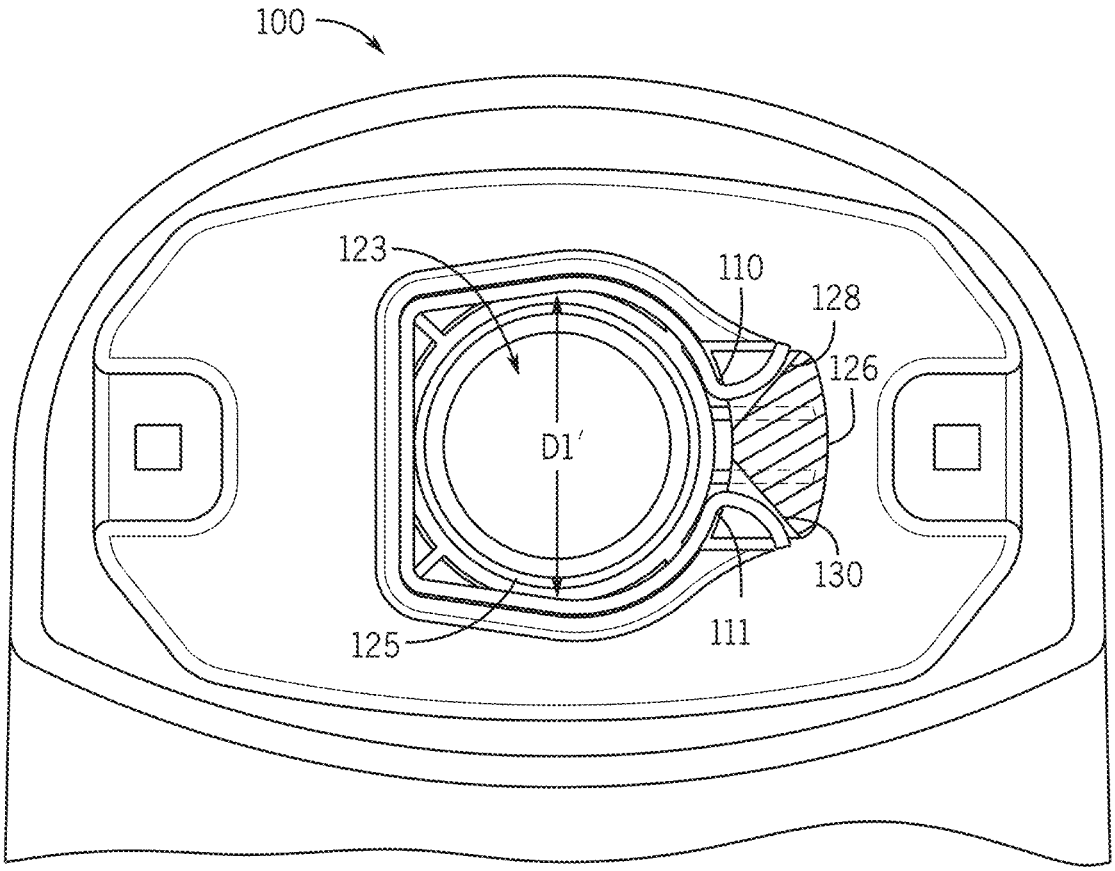
FIGS. 4 and 5 are top cross-sectional views of the quick-coupling mechanism of FIG. 1 in non-locking and locking states, respectively.
Figure 5:
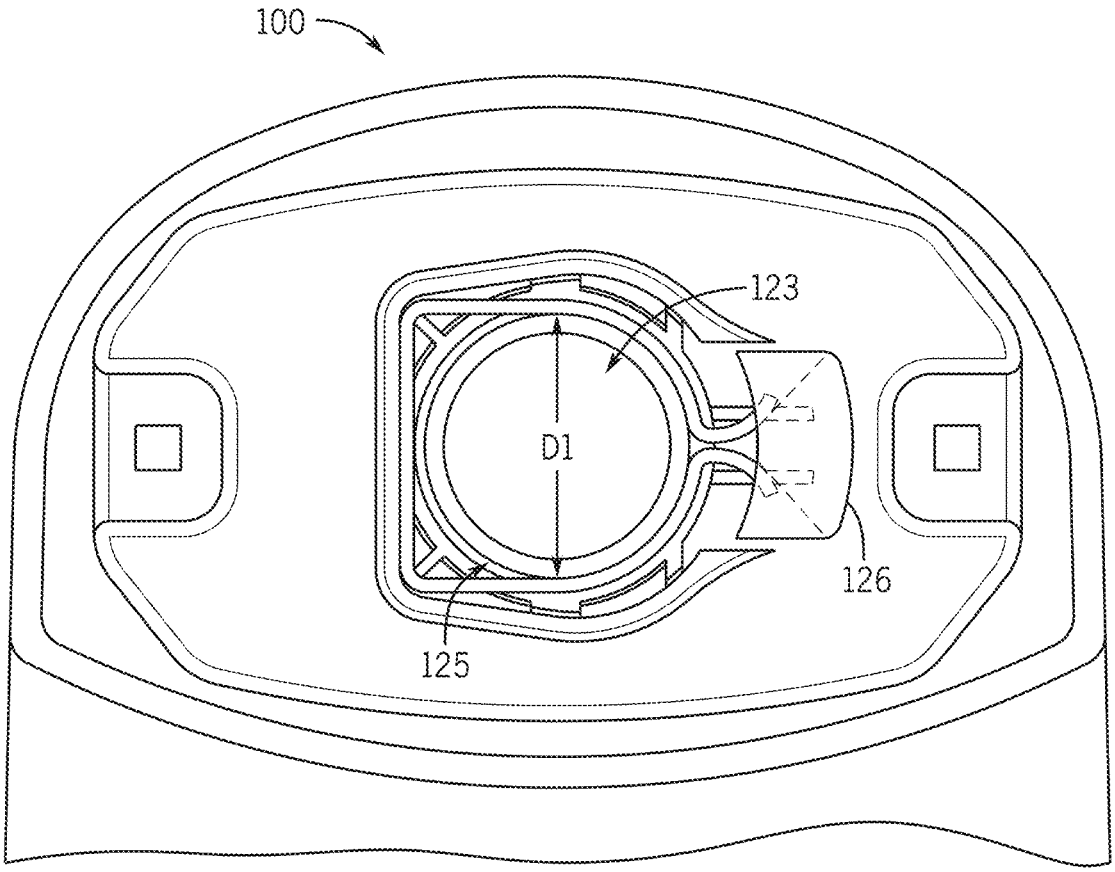

The illustrated quick-coupling mechanism 100 includes a release button 126. The release button 126 is a surface configured to be engaged by a user. The release button 126 may have a cuboidal shape having a flat surface, a spherical shape having a round surface, or have any suitable shape for an actuator or button. As shown in FIG. 4, the release button 126 may have a first driving feature 128 and a second driving feature 130. The first and second driving features 128, 130 may include a ramped or oblique (e.g., diagonal) surface. As shown, the first and second driving features 128, 130 are on opposite ends of the release button 126 such that each of the first and second driving features 128, 130 are associated with one tab 112, 114 of the clamp spring and are angled (e.g., inward) toward the first and second ends 110, 111. The release button 126 is operatively coupled to the first and second tabs 112, 114. The first and second tabs 112, 114 are coupled to the release button 126 on the outside surfaces of the first and second driving features 128, 130. When a user engages the release button 126 (e.g., depresses or pushes a surface of the release button 126, such that the button 126 moves toward the valve body 101), the first and second driving features 128, 130 interface with the first and second tabs 112, 114 such that the first and second tabs 112, 114 move away from each other. An opposing movement of the first and second tabs 112, 114 widens the diameter of the first and second arms 106, 108 and positions the clamp spring 102 in a non-locking state, as shown in FIG. 4. In the non-locking state, a diameter D1' of the clamping portion is larger than the outer diameter of the valve body 101 so that the valve body 101 can move (e.g., slide) relative to the clamp spring 102 along the longitudinal axis. In order to facilitate this configuration, the base structure 116 further prevents the base portion 104 from any lateral movement, thus creating the force allow the first and second arms 106, 118 to bend, or curve outwardly when the release button 126 is engaged.

Figure 6:
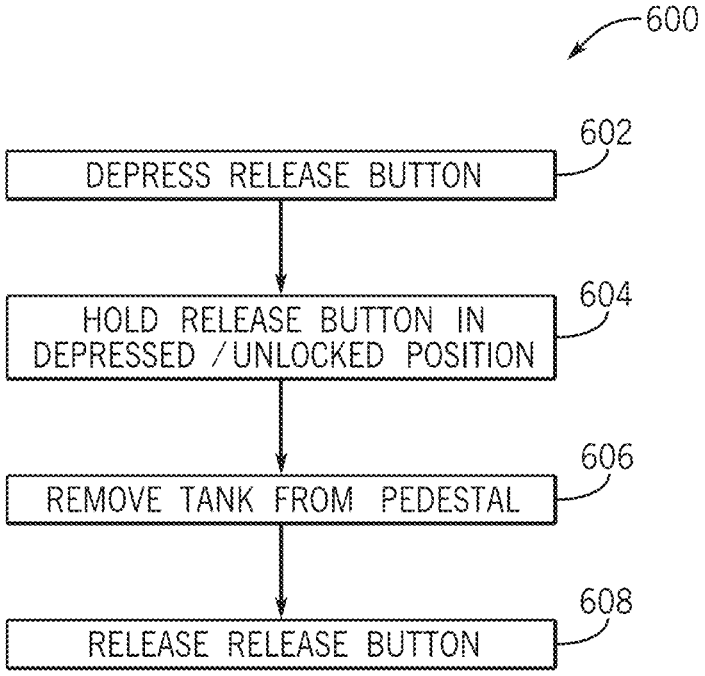
FIG. 6 is a flow chart illustrating a method for using the quick-coupling mechanism of FIG. 1.

Referring to FIG. 6, a method 600 for using a quick-coupling mechanism 100 is shown according to an exemplary embodiment. Not illustrated in FIG. 6, the quick-coupling mechanism couples the tank 1102 to the pedestal 1104 via a single action. That is, the tank 1102 is placed on the pedestal 1104 and snapped into place automatically through a force from gravity and/or a force from the user (e.g., technician or installer). The valve body 101, may be inserted into the quick-connect coupling mechanism 100 (i.e., into the hollow 123 of the base structure 116 and inside the diameter of the clamp spring 102) and aligned to attach the tank 1102 to the bowl or pedestal 1104.

FIG. 6 illustrates the method 600 for releasing the tank 1102 from the pedestal 1104 using the quick-coupling mechanism. At step 602 (e.g., a first step), the method 600 includes depressing the release button 126 such that the release button 126 is pushed inward toward the valve body 101. The release button 126 releases the tank 1102 from the bowl or pedestal 1104. By pushing the release button 126 inward toward the valve body 101, the first and second tabs 112, 114 are pressed in toward the valve body 101. As such, the first and second arms 106, 108 are bent radially, increasing the diameter of the clamp spring 102.

At step 604, the release button 126 may be continuously depressed to retain a larger diameter of the clamp spring 102 than the diameter of the valve body 101. As such, at step 606, valve body 101 is removed from the base structure 116. Once the valve body 101 is removed from the base structure 116 (e.g., allowing the tank 1102 to be removed from the bowl or pedestal 1104), at step 608, the release button 126 may be released (i.e., no longer depressed), and the first and second arms 106, 108 return to the locking position. The first and second arms 106, 108 are secured within the groove 125 of the valve body 101 under the force generated by the clamp spring 102.

Figure 7:
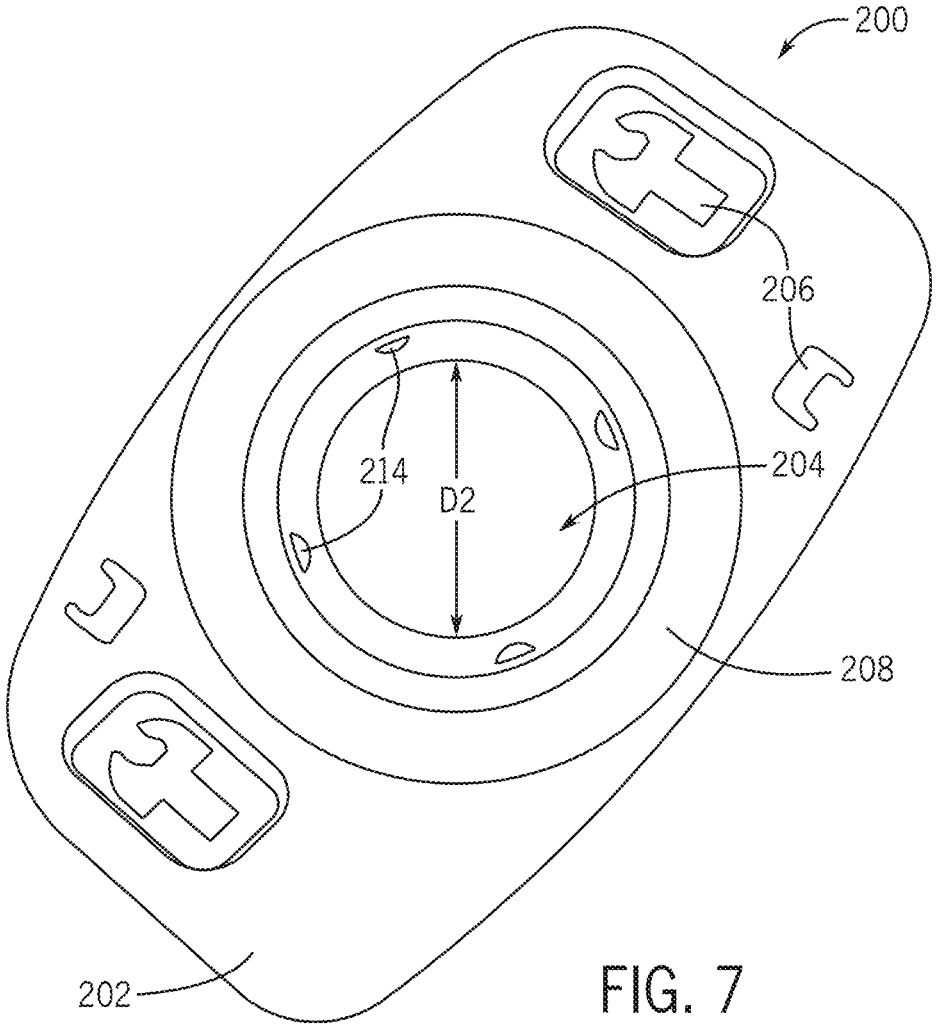
FIG. 7 is a top view of a quick-coupling mechanism, in accordance with an exemplary embodiment of the present application.
Figure 8:
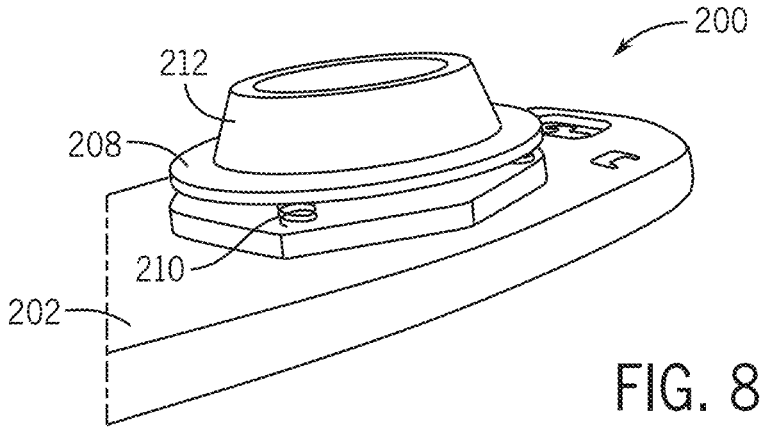
FIG. 8 is a perspective view of the quick-coupling mechanism of FIG. 7.
Figure 9:
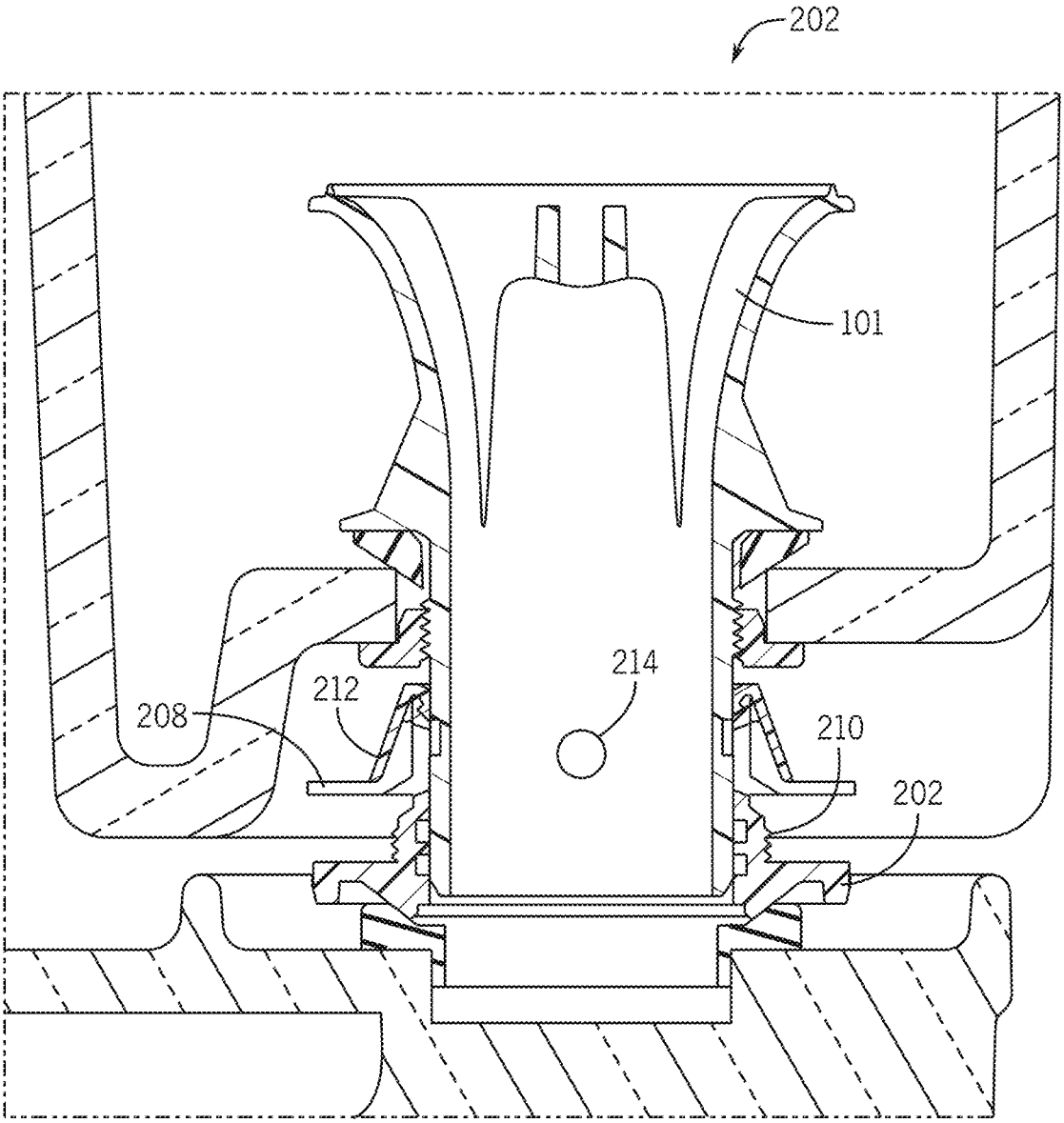
FIG. 9 is a cross-sectional view of the quick-coupling mechanism of FIG. 7.
Figure 11:
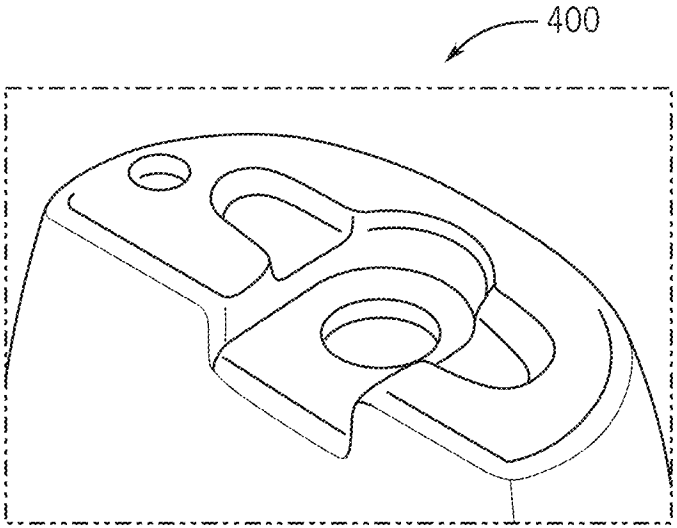
FIGS. 10-13 are bottom views of alternative toilet tanks for coupling with a quick-coupling mechanism, in accordance with an exemplary embodiment of the present application.
Figure 10:
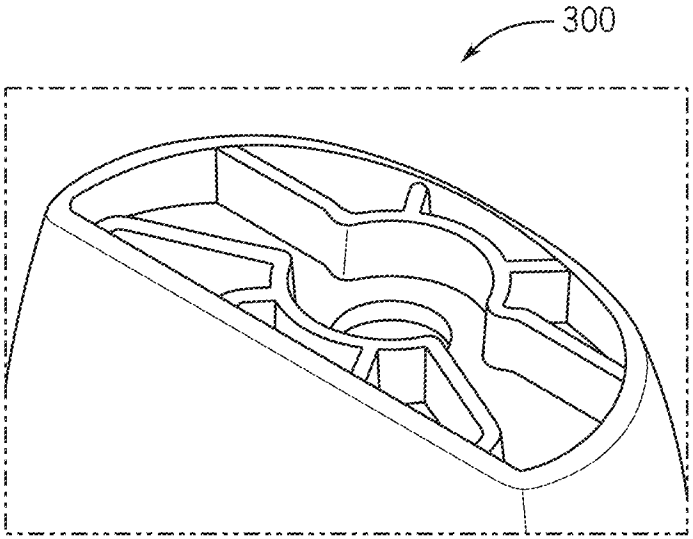
Figure 13:
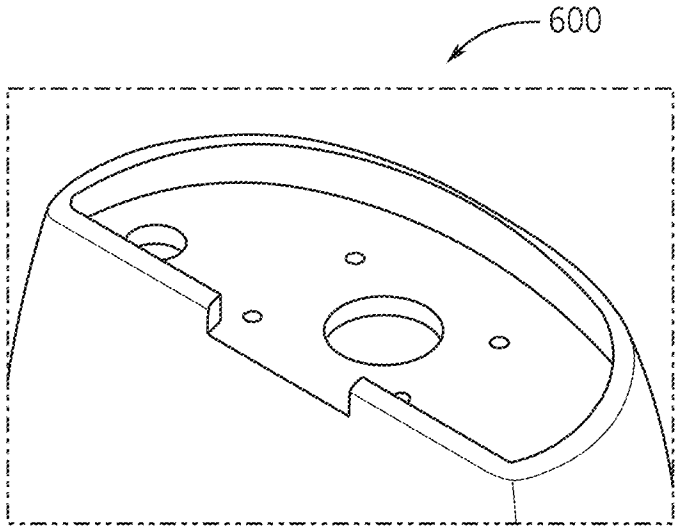
Figure 12:
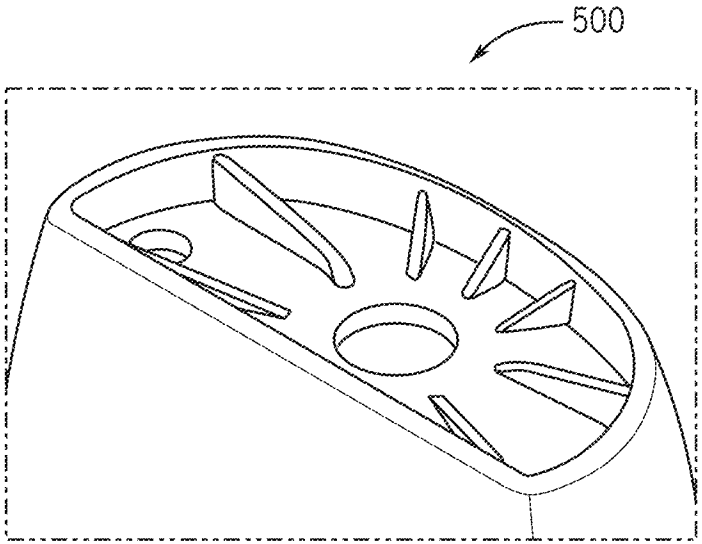

Referring to FIGS. 7-9, a quick-coupling mechanism 200 is shown according to an exemplary embodiment. The quick-coupling mechanism 200 includes a base portion 202. The base portion 202 may include a plate, panel, or similar relatively flat surface. The base portion 202 defines a hollow portion 204 configured to receive the valve body 101. The hollow portion 204 has a base diameter D2 corresponding with the diameter of the valve body 101. The base portion 202 is configured to be coupled to the toilet bowl. For instance, in some embodiments, the base portion 202 may have an attachment feature 206 configured to couple with a complimentary feature on the top surface of the toilet bowl. For instance, the attachment features 206 can include slots configured to receive fasteners that clamp the base portion 202 to the toilet bowl. In some embodiments, the base portion 202 may include a dry-lock plate factory assembled to the bowl. The quick-coupling mechanism 200 includes a collar 208. The base portion 202 and the collar 208 are separated and operatively coupled to at least one retention spring 210. The retention spring 210 is configured to provide the force required to hold the quick-coupling mechanism 200 in place and to release it when released by the user, as explained herein. The quick-coupling mechanism 200 includes an extending feature 212. The extending feature 212 may have a frustoconical shape such that the top end has with a top diameter and a bottom end having a bottom diameter, which is different than the top diameter. The top diameter corresponds with the diameter of the valve body 101 and the hollow portion 204 of the base portion 202 such that the valve body 101 may be inserted into the quick-coupling mechanism 200. As shown, the bottom diameter is coupled to the collar 208 and is larger than the top diameter to provide stability.

The extending feature 212 includes a plurality of roller balls 214. The plurality of roller balls 214 are disposed along an inner ring 216 of the extending feature 212. The plurality of roller balls 214 may be evenly or unevenly spaced along the inner ring 216. The plurality of roller balls 214 according to one example are stainless steel. The plurality of roller balls 214 are configured to be moved radially as the valve body 101 is inserted into the quick-coupling mechanism 200 and to snap back into place when the valve body 101 reaches a locked position with the bowl. When the plurality of roller balls 214 return to their locked position, they are secured within a groove of the valve body 101, thus securing, or locking, the valve body 101 as coupled to the quick-coupling mechanism 200. The quick-coupling mechanism may further include one or more O-rings to provide a seal between the coupled components (e.g., the quick-coupling mechanism 200 to the valve body 101, the quick coupling mechanism 200 to the tank, the quick coupling mechanism 200 to the bowl, etc.). The collar 208 may be pulled downward toward the base portion 202 to release the plurality of roller balls 214 and unlock the valve body 101 from the quick-coupling mechanism 200. In various embodiment, the bottom of the tank 300-600 may include a variety of compatible configurations dependent on the size and shape of the quick-coupling mechanism 200 (or the quick-coupling mechanism 100), as shown in FIGS. 10-13. The base portion 202 may include a circular shape or a rectangular shape, and may be factory assembled. As such, it is beneficial to provide tank designs to accommodate the different fit necessary to couple the tank and the bowl with the quick-coupling mechanism 200. For instance, the bottom of the tank 300, 500 are configured circularly, and the bottom of the tank 400 can accommodate a base portion 202 with flanges.

Thus, the present disclosure describes a quick-coupling mechanism that can, advantageously, provide a secure connection between the toilet bowl and tank while reducing the installation time and difficulty.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. In some cases, the actions recited herein can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

We claim:

1. A quick-coupling mechanism for a toilet, the quick coupling mechanism comprising:

a base structure coupled to a pedestal of the toilet;

a clamp spring having at least two arms coupled to the base structure, the clamp spring configured to receive a valve body associated with a tank of the toilet; and a release button configured to manipulate one or more arms of the clamp spring to disconnect the pedestal of the toilet and the tank of the toilet.

2. The quick-coupling mechanism of claim 1, wherein the valve body is a flush valve configured to flush the toilet.

3. The quick-coupling mechanism of claim 1, wherein the base structure fixedly holds the clamp in place with respect to the pedestal of the toilet.

4. The quick-coupling mechanism of claim 1, wherein the clamp spring seats in a groove in the valve body to secure the valve body and prevent an axial movement of the valve body relative to the clamp spring.

5. The quick-coupling mechanism of claim 1, wherein the release button is configured to bend the one or more arms to release the valve body such that the valve body can move axially relative to the clamp spring.

6. The quick-coupling mechanism of claim 1, wherein the release button causes a change in diameter of a clamping portion of the clamp spring.

7. The quick-coupling mechanism of claim 1, wherein the base structure includes a bottom member, a top member, and a wall extending between the bottom member and the top member.

8. A quick-coupling mechanism for a toilet, the quick coupling mechanism comprising:

a base structure coupled to a pedestal of the toilet;

a clamp spring having at least two arms coupled to the base structure, the clamp spring configured to receive a valve body associated with a tank of the toilet; and a release button configured to manipulate one or more arms of the clamp spring to disconnect the pedestal of the toilet and the tank of the toilet, wherein the base structure includes a bore that extends in a longitudinal direction relative to the valve body.

9. The quick-coupling mechanism of claim 1, wherein the base structure includes an annular channel configured to receive the spring clamp.

10. The quick-coupling mechanism of claim 1, wherein the release button includes a at least one driving mechanism having a slanted surface.

11. The quick-coupling mechanism of claim 10, further comprising:

at least one tab associated with the one or more arms of the clamp spring and configured to be widened under force from the at least one driving mechanism.

12. A toilet comprising:

a pedestal; and a tank configured to be secured to the pedestal via a quick-coupling mechanism for a toilet, the quick coupling mechanism comprising:

a base structure coupled to a pedestal of the toilet;

a clamp spring having at least two arms coupled to the base structure, the clamp spring configured to receive a valve body associated with a tank of the toilet; and a release button configured to manipulate one or more of the at least two arms of the clamp spring to disconnect or connect the pedestal of the toilet and the tank of the toilet.

13. The toilet of claim 12, wherein the clamp spring seats in a groove in the valve body to secure the valve body and prevent an axial movement of the valve body relative to the clamp spring.

14. The toilet of claim 12, wherein the release button is configured to bend the one or more arms to release the valve body such that the valve body can move axially relative to the clamp spring.

15. The quick-coupling mechanism of claim 8, wherein the valve body is a flush valve configured to flush the toilet.

16. The quick-coupling mechanism of claim 8, wherein the clamp spring seats in a groove in the valve body to secure the valve body and prevent an axial movement of the valve body relative to the clamp spring.

17. The quick-coupling mechanism of claim 8, wherein the release button is configured to bend the one or more arms to release the valve body such that the valve body can move axially relative to the clamp spring.

18. The quick-coupling mechanism of claim 8, wherein the release button causes a change in diameter of a clamping portion of the clamp spring.

* * * * *